United States Patent [19]

Gökcek

[11] 4,220,183

[45] Sep. 2, 1980

[54] STEEL CYLINDER FOR THE STORAGE OF GAS MIXTURES

[75] Inventor: Cetin Gökcek, Mulheim an der Ruhr, Fed. Rep. of Germany

[73] Assignee: Messer Griesheim GmbH. Patentabteilung, Frankfurt am Main, Fed. Rep. of Germany

[21] Appl. No.: 932,925

[22] Filed: Aug. 11, 1978

Related U.S. Application Data

[62] Division of Ser. No. 842,414, Oct. 17, 1977, abandoned.

[30] Foreign Application Priority Data

Dec. 22, 1976 [DE] Fed. Rep. of Germany ..... 2364377

[51] Int. Cl.[2] ..... B65B 3/04

[52] U.S. Cl. ..... 141/1

[58] Field of Search ..... 220/64; 428/457; 53/5, 53/22 A, 22 R, 7; 204/26, 432, 49, 53, 54 R, 55 R; 206/0.6; 141/1-12

[56] References Cited

U.S. PATENT DOCUMENTS

| | | | |
|---|---|---|---|
| 1,814,718 | 7/1931 | Mallinckrodt et al. | 53/5 |
| 1,907,579 | 5/1933 | Quelch | 206/0.6 |
| 1,961,936 | 6/1931 | Mallinckrodt et al. | 53/5 |
| 2,419,915 | 4/1947 | Priest et al. | 220/64 |
| 2,426,630 | 9/1947 | Mapes | 206/0.6 |
| 2,444,833 | 7/1948 | Lampert | 220/64 |
| 2,459,123 | 1/1949 | Bates et al. | 220/64 |
| 2,490,978 | 12/1949 | Osterheld | 220/64 |
| 2,521,526 | 9/1950 | Mapes | 206/0.6 |
| 2,639,243 | 5/1953 | Mallinckrodt et al. | 220/64 |
| 3,446,393 | 5/1969 | Falkenau | 220/64 |
| 3,452,250 | 7/1969 | Miller | 220/64 |
| 3,715,231 | 2/1973 | Ng et al. | 220/64 |

FOREIGN PATENT DOCUMENTS

| | | | |
|---|---|---|---|
| 582412 | 7/1955 | Canada | 220/64 |

*Primary Examiner*—Houston S. Bell, Jr.
*Attorney, Agent, or Firm*—Ernest F. Marmorek

[57] ABSTRACT

In a method of preserving in a storage vessel a volumetric ratio of a calibrating gas mixture within a range from below 1 vpm to about 10,000 vpm, wherein the calibrating gas mixture includes a carrier gas and a predetermined trace of another gas, and the storage vessel has inner steel walls electroplated with a metal selected from the group of tin, zinc, nickel and lead, the selection depending on the mixture, the steps include introducing the gases into the storage vessel under relatively high pressure of not more than 200 atmospheres, storing the gases in the storage vessel, so as to preserve the volumetric ratio between the gases within a predetermined accuracy, transporting the gas mixture within the storage vessel, and discharging the calibrating gas mixture from the storage vessel while still retaining the volumetric ratio.

10 Claims, 9 Drawing Figures

STEEL CYLINDER FOR THE STORAGE OF GAS MIXTURES

This is a division of application Ser. No. 842,414, filed Oct. 17, 1977, now abandoned.

BACKGROUND OF THE INVENTION

The containing of gases under pressure in pressure vessels is a well known and universally practiced method of storing and transporting gases commercially. Unfortunately, the commercially available vessels are unsatisfactory for storing high purity gases or high precision gas mixtures. Contamination especially with moisture is a problem with both high purity gases and with precision mixtures. Reaction with the inner wall of the containing vessel is a problem usually associated with precision gas mixtures in that varying reaction rates between the mixture components and the wall of the vessel may result in a gas mixture with a different composition than that which had been originally stored or mixed in the vessel. Contamination of a pure gas mixture as a result of reaction with the wall of the vessels, may also be a problem, when dealing with high purity, very reactive gases such as HF or $F_2$. Thus, a problem with the known pressure vessels is that the quality of high purity gases or the precision of high purity gas mixtures may be degraded by storage in the known vessels due to the effects discussed above.

It has been a practice in the past to compensate for changes expected in the gas mixtures, by altering the original gas mixture to include excess quantities of those components expected to be reduced by the effects discussed above. This solution is not very accurate and therefore not a satisfactory solution to the problem of containing highly pure gases or precision gas mixtures.

Ferrite-perlite(pearlite)-steel is used almost exclusively as the construction material for pressure vessels of the type normally used for containing gases under pressure, this material having been found generally most satisfactory. Of the other materials generally investigated for use, aluminum has been found too soft and temperature sensitive; refined steel is not chemically resistant enough for many of the components and is furthermore very expensive; glass or enamel is too permeable for many gases, quite apart from the insufficient resistance to shocks; and plastics do not have sufficient temperature stability.

In actual practice, when aluminum or refined steel cylinders are used, at best they are used only a few times as their inner surfaces tend to undergo chemical reactions or chemical changes, as a result of which there is imparted unfavorable characteristics with respect to the gases contained therein, to the inner surfaces.

It is possible to improve the performance of ferrite-perlite(pearlite)-steel cylinders by polishing their inner surfaces by a steel blasting technique. This results in a greatly reduced surface area and the removal of oxide layers whereby reactions with the gases contained therein are attenuated. However, the behavior of vessels which have been polished in this manner is still far from ideal.

In summary, the composition of a gas mixture and the quality of a highly pure gas are effected if one or several components are removed, added, or changed in their consistency through interaction of the gas or gas mixtures with the walls of the containing vessel and/or with moisture adsorbed thereon. Excluding interactions between the mixture components and mere phase-transitions, interactions with the surface of the vessel remain the main mixture-changing or contaminating interactions. Thus, adsorption and desorption processes, as well as reactions ranging from chemisorption to chemical bonding play a part here.

SUMMARY OF THE INVENTION

As, in principle, any surface in contact with the contained gas may be involved in an interaction with the gas, it is one of the principle objects of the invention to reduce the surface area and thereby reduce the reaction rate with the surface area.

It is a further object of the instant invention to, at the same time, reduce or eliminate the adsorptive moisture layer and thereby reduce or eliminate a possible reactant with the gas.

Further objects and advantages of the invention will be set forth in part in the following specification and in part will be obvious therefrom without being specifically referred to, the same being realized and attained as pointed out in the claims hereof. Other objects of the invention will in part be obvious and will in part appear hereinafter.

With the above and other objects of the invention in view, the invention consists in the novel construction, arrangement and combination of various elements as set forth in the claims hereof, the results of employing certain embodiments of the same being illustrated in the accompanying drawings and described in the specification.

The invention accordingly comprises a method of preserving in a storage vessel a volumetric ratio of a calibrating mixture which will be exemplified in several examples hereinafter set forth and the scope of the application of which will be indicated in the claims.

It has become apparent that the concentration of moisture in a gas or in a mixture of gases being removed from a pressure vessel, increases with decreasing pressure during the slow emptying of the vessel. It thus appears that a desorbing process is proceeding whereby moisture is leaving the walls of the cylinder as the pressure in the cylinder drops.

As the gas is being removed from the cylinder, the initial moisture content corresponds to an equilibrium between adsorbed moisture on the walls and the partial pressure in the gas. As the gas is removed from the vessel, a certain quantity of water vapor is also removed with the consequential desorption of moisture from the walls to re-establish an equilibrium partial pressure. In the first approximation, the partial pressure does not depend on the total pressure but rather on the temperature. Thus, the partial pressure of the water vapor remains essentially constant while the partial pressure of the gas contained within the cylinder decreases. As the gas is removed from the pressure vessel, the water vapor concentration relative to the other constituents, must therefore increase.

The untreated surfaces of commercial pressure vessels made of ferrite-perlite-steel, aluminum or refined steel have been found to favor the above processes for many different gas mixtures. Attempts to improve the surfaces of the vessels with plastic, enamel or other protective coatings have been unsuccessful due to the insufficient resistance of these coatings to mechanical and thermal shock or to the effects of pressure and vacuum.

Gases and gas mixtures can be produced with such a high degree of purity that the magnitude of total impurities is less than 1 vpm. When such high degrees of purity are involved, the foreign gases which are desorbed from the surface of the pressure vessel may well determine the quality of the gas removed from the vessel. The moisture concentration in the gas which is removed from the vessel is essentially determined by the characteristics of the surface of the vessel in question. As it is an object of the instant invention to create a vessel suitable for storage of very high purity gases or gas mixtures, the instant invention teaches a vessel wherein the inner surface has been changed. In accordance with the invention, this is achieved by means of coating the inner surface of the vessel with a metal coating.

Although in the preferred embodiments, tin or zinc are electroplated to the inner surface of a steel cylinder, other metals have been found to be more suitable when very reactive gases are being contained. Thus, for the storage of hydrogen fluoride, lead was found to be a suitable coating. For the storage of fluorine or ammonia, nickel was found to be a suitable coating.

The storage of high purity gases or gas mixtures in pressure vessels according to the instant invention will permit subsequent removal of these gases with extremely high purity maintained during the essentially complete removal of gases from the pressure vessel and for an extended storage period, as is shown in the examples below.

BRIEF DESCRIPTION OF THE DRAWINGS

For a fuller understanding of the nature and the objects of the invention, reference should be had to the following detailed description, taken in connection with the accompanying drawings, in which.

Figure 1:
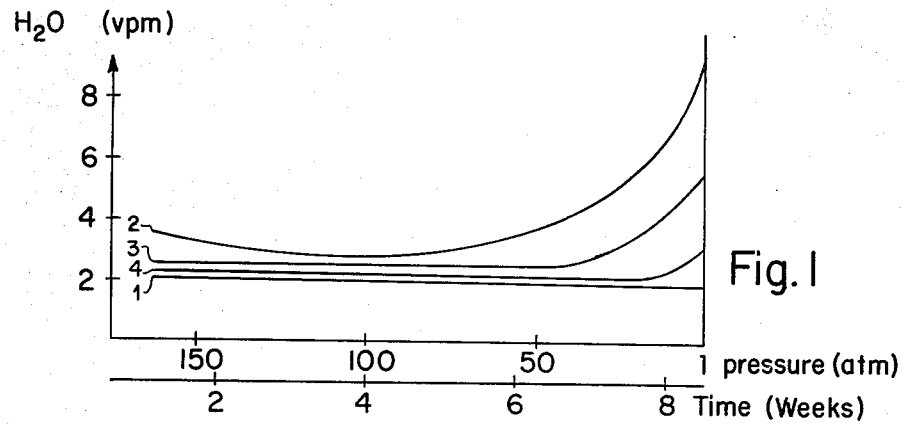
FIG. 1 shows a comparison in the moisture content of gases removed from various pressure vessels over a range of pressures.

In each of the FIGS. 1–9, there are four curves numbered 1 to 4 which represent the following:

Curve 1: Behavior of an ideal vessel;

curve 2: behavior of a commercial ferrite-perlite steel cylinder;

curve 3: behavior of a ferrite-perlite steel cylinder whose inner surface has been polished by steel blasting; and curve 4: behavior of a ferrite-perlite steel cylinder prepared in accordance with the instant invention as described below.

Additionally, presented in the following discussion are tables 1 to 8 which correspond to FIGS. 1 to 8, respectively and tables 9 and 10 which correspond to FIG. 9.

DESCRIPTION OF THE PREFERRED EMBODIMENTS

In carrying the invention into effect in the embodiments which have been selected for illustration in the accompanying drawings and for description in this specification and in the tables presented below, and referring now particularly to FIGS. 1 to 4 and corresponding tables 1 to 4 wherein the embodiment comprises a steel cylinder with tin coating applied by electroplating; the measured variable being the water content in an inert gas.

Figure 5:
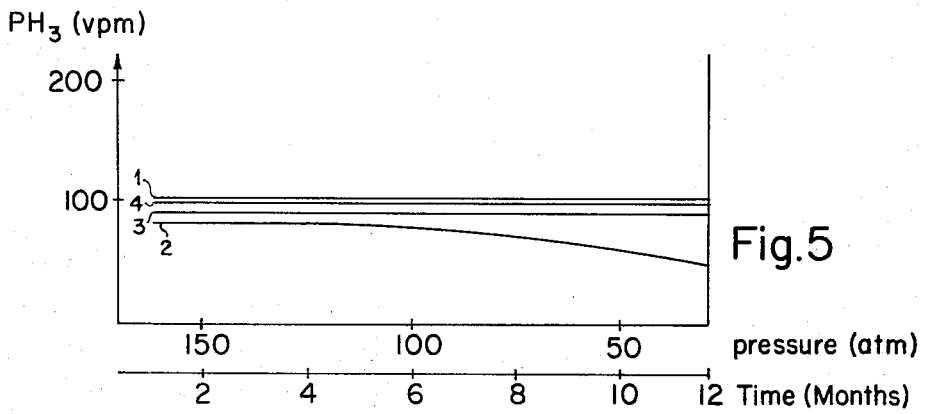
FIG. 5 is similar to FIG. 2, but it shows the phosphine content in gas removed from various vessels to which 100 vpm of phosphine ($PH_3$) had been added.
Figure 6:
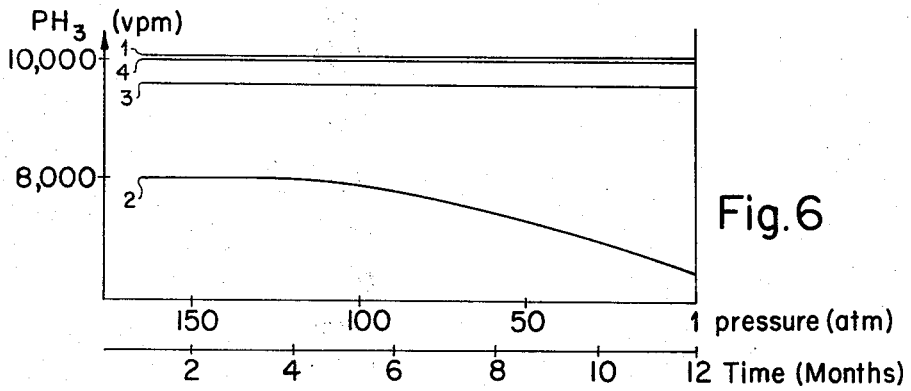
FIG. 6 is similar to FIG. 5, but 1 percent phosphine had been added.

Another embodiment of the instant invention selected for illustration, with reference particularly to FIGS. 5 and 6 and corresponding tables 5 and 6, comprises the use of a zinc coating applied by electroplating to the inner surface of a steel cylinder wherein phosphine is the measured variable contained in an inert gas.

Figure 7:
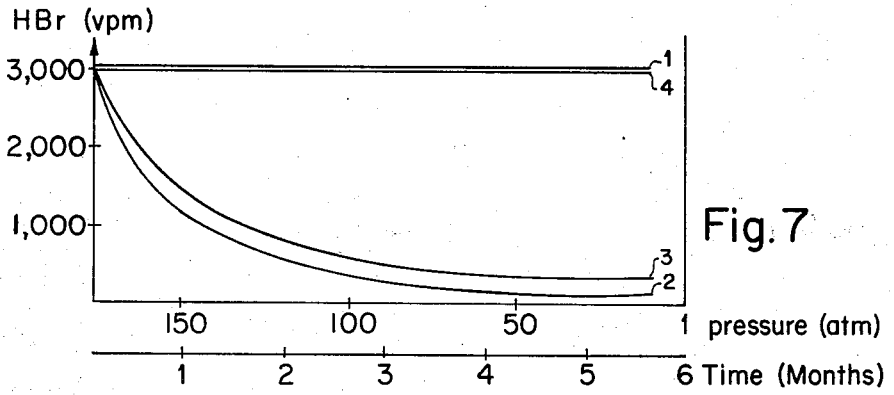
FIG. 7 is similar to FIG. 2, but it shows the Hydrobromic Acid content in gases removed from various vessels to which 3,000 vpm of Hydrobromic Acid (HB) had been added.
Figure 8:
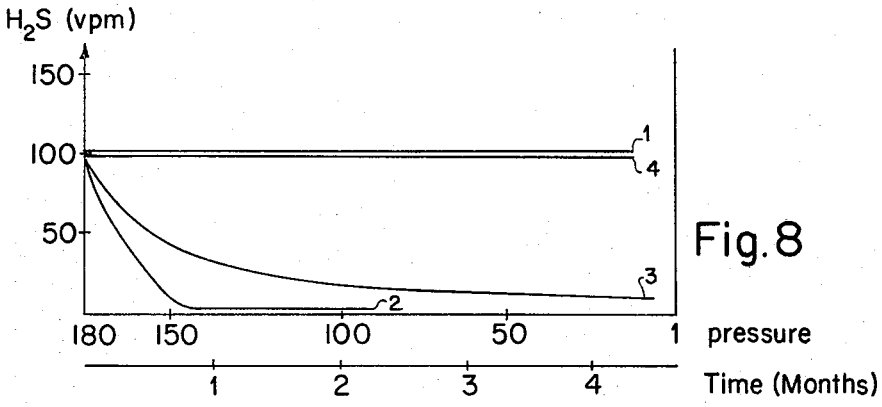
FIG. 8 is similar to FIG. 2, but shows the hydrogen sulfide contents removed from various vessels to which 100 vpm of hydrogen sulfide ($H_2S$) had been added.

Still further embodiments of the instant invention are similarly illustrated in FIG. 7 and corresponding table 7 wherein the metal coating is zinc and the measured variable is hydrogen bromide; FIG. 8 and corresponding table 8 wherein the metal coating is tin and the measured variable is hydrogen sulfide; and FIG. 9 and corresponding tables 9 and 10 wherein the metal coating is tin and the measured variable is nitrogen dioxide.

In the embodiment illustrated in FIG. 1 and Table 1, an inert gas was compressed to about 150 to 200 atmospheres in extremely dry, pretreated pressure vessels. After cooling down of the vessel, the moisture in the outflowing gas is measured with the aid of a hygrometer. Care has to be taken that the measuring cell lies as close as possible to the valve of the vessel.

As can be seen from Table 1 and from FIG. 1, the pressure vessel which is provided with a tin-coating, surprisingly shows no desorption of moisture in contrast to the other types of vessels with which it was compared.

Thus, by using pressure vessels in accordance with the instant invention, it is now possible to store gases with extreme purity, the quality of which can be maintained as the vessel is emptied.

TABLE 1

| Type of vessel | Pressure in vessel (atmospheric excess pressure) | $H_2O$ - vapor (vpm) |
|---|---|---|
| Behavior in the ideal state | 160 | 1.0 |
| | 1 | 1.0 |
| Ferrite-perlite-steel | 160 | 1.5–2.0 |
| | 70 | 2.5–3.0 |
| | 1 | 3.0–30.0 |
| Ferrite-perlite-steel, steel blasted | 160 | 1.0–1.5 |
| | 50 | 1.5–2.0 |
| | 1 | 3.0–15.0 |
| Ferrite-perlite-steel with tin coating applied through electroplating | 160 | 1.0 |
| | 1 | 1.0–2.0 |

Figure 2:
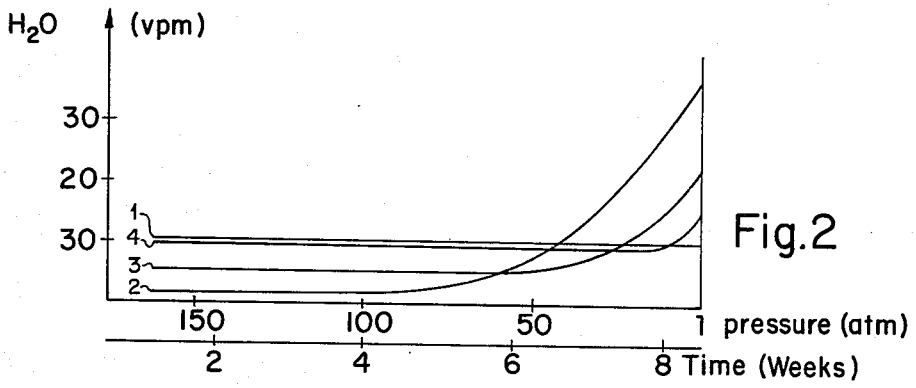
FIG. 2 is similar to FIG. 1 except 10 vpm of water was added to each vessel.
Figure 3:
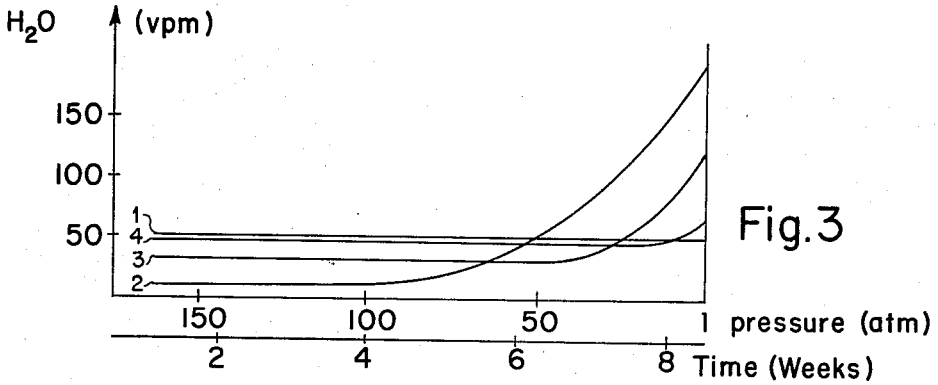
FIG. 3 is similar to FIG. 2, but 50 vpm were added to each vessel.
Figure 4:
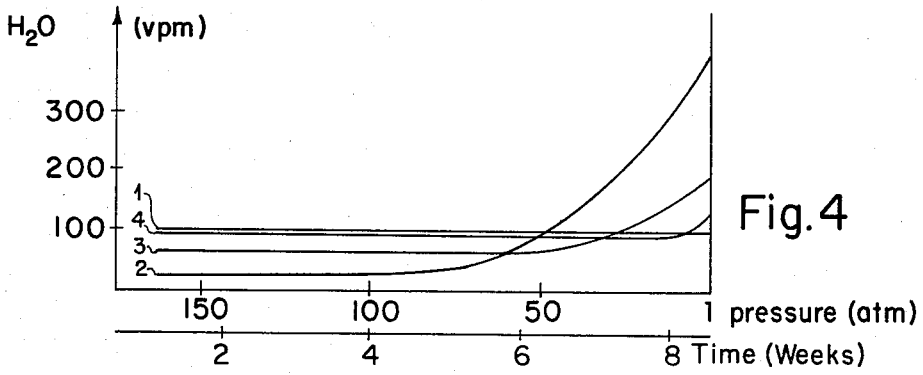
FIG. 4 is similar to FIG. 3, but 100 vpm were added to each vessel.

Further experiments with higher water-vapor partial pressures in the filled pressure vessels are shown in FIGS. 2 to 4 and corresponding to Tables 2 to 4.

Into extremely dry pressure vessels for gases, moisture in form of distilled water was added by means of a calibrated micro-syringe; in order to avoid contamination due to atmospheric moisture leaking into the vessel-system during the treatment process, this process was carried out at low vessel pressure. Subsequently, the vessel's valve was closed. By use of a manometer, the pressure vessels which had been pretreated in this manner were now compressed with the desired carrier gas until the intended relative moisture concentration was attained.

Initially at high filling pressure, the measured values which were obtained in the cases of commercially available pressure vessels (recorded in Tables 2 to 4 and in FIGS. 2 to 4), show considerably less water-vapor in the drawn-off gas than was expected from the amount added. This was presumably caused by adsorption on the walls of the container. At decreasing pressure, this moisture is desorbed again and therewith increases the water-vapor content in the outflowing gas.

Although it is found that by calculating the total drawn-off quantity of water (the desorption quantity), except for a small residue, the quantity corresponds to the originally added water quantity; in the case of such a behavior it is impossible to maintain constant, the water-vapor concentration of the drawn-off gas over the entire removal range.

On the other hand, as is shown in FIGS. 2 to 4 and Tables 2 to 4, in the cases of pressure vessels provided with a tin coating in accordance with the instant invention, surprisingly no water is adsorbed at high partial pressures as e.g. 15 Torr 0.00 vpm $H_2O$ at 1 bar. 295° K. compressed to 160 bar) and, therefore, the content of the pressure vessel can be removed with a relatively constant, specified moisture concentration.

The storage and subsequent dispensing to a low vessel pressure of gases with a relatively constant specified moisture content, is thus possible with the aid of pressure vessels in accordance with the embodiment of the instant invention discussed above. In Tables 2 to 4, the last column (desorption—atmospheric excess pressure) shows the vessel pressure at which the desorption of the water from the inner surface of the pressure vessel begins.

TABLE 2

| Type of vessel | vessel pressure -atmospheric excess pressure- | added -vpm- | measured -vpm- | desorption -atmospheric excess pressure- |
|---|---|---|---|---|
| Behavior in the ideal state | 160 | 10.0 | 9.5–10.5 | 1–5 |
| Ferrite-perlite-steel | 160 | 10.0 | 1.5–2.5 | 65–75 |
| Ferrite-perlite-steel-steel-blasted | 160 | 10.0 | 4.5–6.0 | 35–55 |
| Ferrite-perlite-steel with tin coating applied through electroplating | 160 | 10.0 | 9.0–10.5 | 1–5 |

TABLE 3

| Type of vessel | vessel pressure -atmospheric excess pressure- | added -vpm- | measured -vpm- | desorption -atmospheric excess pressure- |
|---|---|---|---|---|
| behavior in the ideal state | 160 | 50.0 | 47.5–52.5 | 1 |
| ferrite-perlite-steel "commercially available" | 160 | 50.0 | 15.0–25.0 | 50–70 |
| steel-blasted | 160 | 50.0 | 40.0–50.0 | 40–60 |
| with tin coating applied through electroplating | 160 | 50.0 | 48.0–52.0 | 1 |

TABLE 4

| | | | | |
|---|---|---|---|---|
| behavior in the ideal state | 160 | 100.0 | 95.0–105.0 | 1 |
| ferrite-perlite-steel | 160 | 100.0 | 40.0–60.0 | 70–90 |
| steel-blasted | 160 | 100.0 | 80–95.0 | 40–60 |
| with tin coating applied through electroplating | 160 | 100.0 | 100.0 | 1 |

In Tables 5 and 6, as well as in the corresponding FIGS. 5 and 6, embodiments for use with inorganic gas mixtures are illustrated. Gas mixtures with inorganic components, such as e.g. arsine ($AsH_3$), phosphine ($PH_3$), monosilane ($SiH_4$) and diborane ($B_2H_6$), find increasing use as calibration standards in which case they are referred to as "calibrating gases" and as measured components, or reaction-gases.

These inorganic components are used in all cases in which higher requirements are made with respect to the concentration stability.

In general, as in the example of the $PH_3$-mixtures, a curve representing the data results which is of the type illustrated in FIGS. 5 and 6. Steel cylinders constructed in accordance with the embodiments of the invention comprising electroplated zinc on the inner walls were utilized, as in this case zinc had proven itself to be superior to tin.

The measured addition of $PH_3$ was accomplished manometrically, in the absence of oxygen and moisture, and in pretreated, extremely dry pressure vessels.

For the investigations, two concentration ranges, namely 100 and 10,000 vpm, were selected and the concentration-content of the latter was determined weekly.

As can be seen from Tables 5 and 6 and FIGS. 5 and 6, the $PH_3$-mixtures can be removed from the commercially available pressure vessels only at a concentration which is substantially lower than the concentration at which they were added, the reason for the discrepancy being that a portion of the added $PH_3$ is hydrolized and adheres to the wall in the form of phosphoric acid.

This reaction appears to continue with time and with decreasing vessel pressure, resulting in a phosphine concentration which continues to slowly decrease.

As can be seen from the Tables 5 and 6 and FIGS. 5 and 6, however, the mixtures from the pressure vessels designed according to the embodiment of the instant invention, wherein the vessel's walls are provided with a zinc coating applied through electroplating, are very stable over a period of time and during removal and, in addition, furnish the concentration value expected from the amount originally added.

Although cylinders polished by steel blasting (curve 3) also furnish satisfactory results, danger exists that the cylinders will corrode and become unusable after a few uses.

TABLE 5

| pressure vessel* | vessel pressure -atmospheric excess pressure | added $PH_3$ -vpm- | measured $PH_3$ -vpm- | | stability -in years- |
|---|---|---|---|---|---|
| behavior in the ideal state | 160 | 100.0 | 100.0 | ±5% | 1 |
| ferrite-perlite steel, "commercially available" | 160 | 100.0 | 91.0–65.0 | ±5% | 1 |
| steel-blasted | 160 | 100.0 | 95.0–85.0 | ±5% | 1 |
| with zinc coating applied through electroplating | 160 | 100.0 | 100.0 | ±5% | 1 |

TABLE 6

| | | | | | |
|---|---|---|---|---|---|
| behavior in the ideal state | 160 | 10,000 | 10,000 | ±5% | ½ |
| ferrite-perlite steel, "commercially available" | 160 | 10,000 | 9,500–7,500 | ±5% | 1 |
| steel-blasted | 160 | 10,000 | 9,700–8,900 | ±5% | 1 |
| with zinc coating applied through electroplating | 160 | 10,000 | 10,000 | ±5% | 1 |

Figure 9:
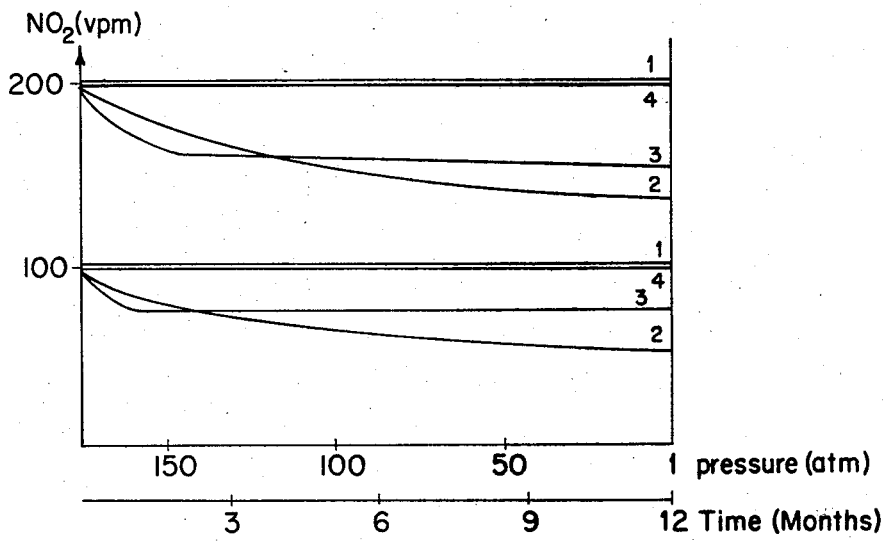
FIG. 9 is similar to FIG. 2, but it shows the nitrogen dioxide content in gases removed from various vessels to which 100 or 200 vpm of nitrogen dioxide ($NO_2$) had been added.

FIGS. 7 to 9 and the corresponding tables 7 to 10 show examples for gas mixtures with corrosive components. We are dealing here with hydrogen bromide (Table 7 and FIG. 7), hydrogen sulfide (Table 8 and FIG. 8) and nitrogen dioxide (Tables 9 and 10 and FIG. 9).

For hydrogen bromide, zinc-coated steel cylinders designed in accordance with the invention were used, for the other components, tin-coated ones were used.

The addition of measured amounts of HBr, $H_2S$ and $NO_2$ was carried out manometrically in extremely dry pressure vessels. With the carrier gas, which is likewise compressed manometrically, one can determine the reference or expected value of the mixture-concentration in each case.

The concentration patterns of curves 1 and 4 shown in FIGS. 7, 8 and 9, clearly show a surprising stability in comparison with those obtained with commercially available pressure vessels and also in comparison with those obtained with clean steel surfaces, which had been polished and freed of oxide layers through steel blasting.

In accordance with the process of the invention it is now possible to guarantee for corrosive components such as HBr, $H_2S$ and $NO_2$, a timely stability and a removal-pressure stability of the mixtures drawn-off.

TABLE 7

| Type of vessel | pressure -atmospheric excess pressure | added HBr -vpm- | measured HBr -vpm- | | stability -in weeks- |
|---|---|---|---|---|---|
| behavior in the ideal state | 160<br>1 | 3,000 | 3,000 | ±5% | 24 |
| ferrite-perlite steel, "commercially available" | 160 | 3,000 | 230 | ±5% | 10 |
| ferrite-perlite steel, "steel-blasted" | 160 | 3,000 | 340 | ±5% | 10 |
| ferrite-perlite-steel, "zinc-coated" | 160<br>1 | 3,000 | 3,000 | ±5% | 24 |

TABLE 8

| | | added $H_2S$ | measured $H_2S$ | | |
|---|---|---|---|---|---|
| behavior in the ideal state | 160<br>1 | 100 | 100 | ±5% | 24 |
| ferrite-perlite steel, "commercially available" | 160<br>150 | 100<br>— | 0.5<br>— | ±5%<br>— | 1 |
| ferrite-perlite steel, "steel-blasted" | 160<br>— | 100<br>— | 54.0<br>40.0 | ±5% | —<br>— |
| ferrite-perlite steel, "tin-coated" | 160<br>1 | 100 | 100.0<br>100.0 | ±5% | 24 |

TABLE 9

| Type of vessel | pressure -atmospheric excess pressure- | added $NO_2$ -vpm- | measured $NO_2$ -vpm- | | stability -in weeks |
|---|---|---|---|---|---|
| behavior in the ideal state | 160<br>1 | 100 | 100<br>100 | ±2% | 24 |
| ferrite-perlite steel, "commercially available" | 160<br>— | 100 | 73<br>62 | ±2%<br>— | —<br>— |
| ferrite-perlite steel, "steel-blasted" | 160<br>— | 100 | 83<br>75 | ±2%<br>— | 24 |

TABLE 9-continued

| Type of vessel | pressure -atmospheric excess pressure- | added $NO_2$ -vpm- | measured $NO_2$ -vpm- | | stability -in weeks |
|---|---|---|---|---|---|
| ferrite-perlite | 160 | 100 | 96 | ±2% | 24 |
| steel, "tin-coated" | 1 | | 96 | | |

TABLE 10

| | | added $NO_2$ -vpm- | measured $NO_2$ -vpm- | | |
|---|---|---|---|---|---|
| behavior in | 160 | 200 | 200 | ±2% | |
| the ideal state | 1 | — | — | — | 24 |
| ferrite-perlite | 160 | 200 | 145 | ±2% | |
| steel, "commercially available" | — | — | — | | 24 |
| ferrite-perlite | 160 | 200 | 165 | ±2% | |
| steel, "steel-blasted" | — | — | 150 | | 24 |
| ferrite-perlite | 160 | 200 | 196 | ±2% | 24 |
| steel, "tin-coated" | 1 | — | 196 | | |

Additional examples of embodiments of the instant invention for use with various gases to be contained are as follows:

1. The use of a metal coating in accordance with the instant invention comprising lead, for storage of hydrogen fluoride.

2. The use of a metal coating in accordance with the instant invention comprising nickle, for storage of fluorine gas and for storage of hydrogen chloride.

3. The use of a metal coating in accordance with the instant invention comprising nickel for storage of sulfur dioxide.

4. Other steel vessels and zylinders are suitable for the practice of the instant invention; for instance vessels with spherical or rectangular form.

5. Electroplating is the only suitable method of applying the metal coating.

I wish it to be understood that I do not desire to be limited to the exact details of construction shown and described, for obvious modifications will occur to a person skilled in the art.

Having thus described the invention, what I claim as new and desire to be secured by Letters Patent, is as follows:

1. In a method of preserving in a storage vessel a volumetric ratio of a calibrating gas mixture within a range from below 1 vpm to about 10,000 vpm, said calibrating gas mixture including a carrier gas and a predetermined trace of another gas, said storage vessel having inner steel walls electroplated with a metal selected from the group of tin, zinc, nickel and lead, the selection depending on the mixture, the steps comprising:

introducing said gases into said storage vessel under relatively high pressure of not more than 200 atmospheres;

storing said gases in said storage vessel, so as to preserve the volumetric ratio between said gases within a predetermined accuracy, transporting said gas mixture within said storage vessel, and discharging said calibrating gas mixture from said storage vessel while still retaining said volumetric ratio.

2. In a method according to claim 1, wherein the composition of the gases or gas mixtures includes a predetermined amount of moisture, and wherein the gas or gas mixtures are discharged, so that the predetermined amount of moisture stays relatively constant.

3. In a method according to claim 2, wherein the predetermined amount of moisture is defined in terms of a predetermined water vapor pressure, and wherein the ratio of the water vapor pressure at said relatively low pressure to the water vapor pressure at said relatively high pressure does not exceed a factor of two.

4. In a method according to claim 1 wherein the storing step includes storing and confining gas including at least one component from the group comprising fluorine and hydrogen chloride.

5. In a method as claimed in claim 1, wherein said carrier gas is an inert gas, and wherein said other gas is a tracer gas taken from the group consisting of $H_2O$, $NO_2$, $SO_2$, $H_2S$, HBr, $AsH_3$, $PH_3$, $SiH_4$, $B_2H_6$, F, and HCl.

6. In a method as claimed in claim 1, wherein said carrier gas is an inert gas, and wherein said other gas is a tracer gas taken from the group consisting of $H_2O$, $NO_2$, $SO_2$, $H_2S$, HBr, $AsH_3$, $PH_3$, $SiH_4$, $B_2H_6$, F, and HCl.

7. In a method as claimed in claim 1, wherein said carrier gas is an inert gas, and wherein said inner steel walls are electroplated with tin, and said other gas is a tracer gas taken from the group consisting of $H_2O$, $NO_2$, $SO_2$ and $H_2S$, and wherein said predetermined accuracy is a measured accuracy of about ±2% within the range from below 1 vpm to about 10,000 vpm.

8. In a method as claimed in claim 1, wherein said carrier gas is an inert gas, said inner walls are electroplated with zinc, said other gas is taken from the group consisting of HBr, $AsH_3$, $PH_3$, $SiH_4$ and $B_2H_6$, and wherein said predetermined accuracy is a measured accuracy of about ±5% within the range from below 1 vpm to about 10,000 vpm.

9. In a method as claimed in claim 1, wherein said carrier gas is an inert gas, said inner steel walls are electroplated with nickel, said other gas is a tracer gas taken from the group consisting of F and HCl.

10. In a method as claimed in claim 1, wherein said carrier gas is an inert gas, said inner steel walls are electroplated with lead, said other gas is a tracer gas consisting essentially of hydrogen fluoride.

* * * * *

UNITED STATES PATENT OFFICE

CERTIFICATE OF CORRECTION

Patent No. 4,220,183 Dated September 2, 1980

Inventor(s) Cetin Gökcek

It is certified that error appears in the above-identified patent and that said Letters Patent are hereby corrected as shown below:

In the Heading:

in item [62] the word "abandoned" is replaced by the following: --which is a Continuation of Ser. No. 535,830, filed Monday, December 23, 1974--;

in item [30] the year "1976" is replaced by --1973--.

In the Specification:

in the preamble, column 1, second line, the words "now abandoned" are replaced by the following: --which is a Continuation of Ser. No. 535,830 filed December 23, 1974--.

Signed and Sealed this

*Eighteenth* Day of *August 1981*

[SEAL]

*Attest:*

GERALD J. MOSSINGHOFF

*Attesting Officer*

*Commissioner of Patents and Trademarks*